US007789745B2

(12) United States Patent
Walker et al.

(10) Patent No.: US 7,789,745 B2
(45) Date of Patent: Sep. 7, 2010

(54) PRODUCTS AND PROCESSES FOR APPLYING CONDITIONS TO A LOTTERY ENTRY

(75) Inventors: Jay S. Walker, Ridgefield, CT (US); Stephen C. Tulley, Fairfield, CT (US); James A. Jorasch, Stamford, CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 11/424,408

(22) Filed: Jun. 15, 2006

(65) Prior Publication Data

US 2006/0223619 A1 Oct. 5, 2006

Related U.S. Application Data

(63) Continuation of application No. 10/843,198, filed on May 11, 2004, which is a continuation-in-part of application No. 10/162,823, filed on Oct. 25, 2001, now Pat. No. 6,733,387, which is a continuation of application No. 09/627,192, filed on Jul. 27, 2000, now Pat. No. 6,325,716, which is a continuation of application No. 08/912,185, filed on Aug. 15, 1997, now Pat. No. 6,146,272.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/17; 273/139; 273/269; 463/16; 463/19; 463/22; 463/25

(58) Field of Classification Search ..... 273/139, 273/269; 463/16, 17, 19, 22, 25
See application file for complete search history.

(56) References Cited

U.S. PATENT DOCUMENTS

| | | | | |
|---|---|---|---|---|
| 4,764,666 | A | 8/1988 | Bergeron | 235/380 |
| 4,833,307 | A | 5/1989 | Gonzalez-Justiz | 235/375 |
| 4,882,473 | A | 11/1989 | Bergeron et al. | 235/380 |

(Continued)

FOREIGN PATENT DOCUMENTS

| | | |
|---|---|---|
| EP | 0 307 925 A2 | 3/1989 |

(Continued)

OTHER PUBLICATIONS

"Michigan Lotto creates another millionaire", Sep. 16, 1984, Section: Regional News, Distribution: Michigan, Copyright 1984 U.P.I, 1pg.

(Continued)

*Primary Examiner*—John M Hotaling, II
*Assistant Examiner*—Adetokunbo Torimiro
(74) *Attorney, Agent, or Firm*—Fincham Downs LLC

(57) ABSTRACT

Products and processes are disclosed for receiving a lottery record associated with a sale of a lottery ticket. The lottery record includes a plurality of lottery numbers, and a condition for creating at least one entry that includes the lottery numbers in a lottery drawing. It is determined if the condition is satisfied. The at least one entry in the lottery drawing is created only if the condition satisfied.

8 Claims, 13 Drawing Sheets

U.S. PATENT DOCUMENTS

| | | | | | |
|---|---|---|---|---|---|
| 4,922,522 | A | * | 5/1990 | Scanlon | 463/17 |
| 4,937,853 | A | | 6/1990 | Brule et al. | 379/96 |
| 4,996,705 | A | * | 2/1991 | Entenmann et al. | 463/17 |
| 5,082,275 | A | | 1/1992 | Nilssen | 273/138 A |
| 5,112,050 | A | | 5/1992 | Koza et al. | 273/139 |
| 5,119,295 | A | | 6/1992 | Kapur | 364/412 |
| 5,158,293 | A | | 10/1992 | Mullins | 273/139 |
| 5,223,698 | A | | 6/1993 | Kapur | 364/412 |
| 5,232,221 | A | | 8/1993 | Sludikoff et al. | 273/139 |
| 5,310,997 | A | | 5/1994 | Roach et al. | |
| 5,327,485 | A | | 7/1994 | Leaden | 379/95 |
| 5,330,185 | A | | 7/1994 | Wells | 273/138 A |
| 5,354,069 | A | | 10/1994 | Guttman et al. | 273/439 |
| 5,362,064 | A | | 11/1994 | Lofink et al. | |
| 5,398,932 | A | | 3/1995 | Eberhardt et al. | 273/138 A |
| 5,403,999 | A | | 4/1995 | Entenmann et al. | 235/379 |
| 5,415,416 | A | * | 5/1995 | Scagnelli et al. | 463/25 |
| 5,417,430 | A | | 5/1995 | Breeding | |
| 5,472,196 | A | * | 12/1995 | Rusnak | 463/18 |
| 5,544,892 | A | | 8/1996 | Breeding | |
| 5,613,680 | A | | 3/1997 | Groves et al. | 273/138.2 |
| 5,713,795 | A | | 2/1998 | Kohorn | 463/17 |
| 5,722,890 | A | | 3/1998 | Libby et al. | 463/17 |
| 5,791,990 | A | | 8/1998 | Schroeder et al. | 463/17 |
| 5,871,398 | A | | 2/1999 | Schneier et al. | 463/16 |
| 5,910,047 | A | | 6/1999 | Scagnelli et al. | 463/17 |
| 5,917,893 | A | | 6/1999 | Katz | 379/93.02 |
| 5,997,002 | A | | 12/1999 | Goldman | |
| 6,028,920 | A | * | 2/2000 | Carson | 379/114.2 |
| 6,146,272 | A | | 11/2000 | Walker et al. | 463/17 |
| 6,733,387 | B2 | | 5/2004 | Walker et al. | |
| 2003/0073485 | A1 | | 4/2003 | Friedman | |
| 2004/0014514 | A1 | | 1/2004 | Yacenda | |
| 2006/0084506 | A1 | | 4/2006 | Yoseloff et al. | |

FOREIGN PATENT DOCUMENTS

| | | | |
|---|---|---|---|
| EP | 0 307 925 | B1 | 1/1993 |
| EP | 0 620 688 | A2 | 10/1994 |

OTHER PUBLICATIONS

Schapiro, Jeff E., "Virginia Lottery", The Richmond Times Dispatch, Aug. 4, 1996, Section:Discover Richmond, p. S-89, 3pp.

Larkin, Leah, "Playing the lottery card", International Gaming and Wagering Business, Dec. 1996, Section: p. 34, ISSN: 8750-8222, 3pp.

Notice of Allowability for U.S. Appl. No. 08/912,185, mailed May. 25, 2000, 2 pp.

Office Action for U.S. Appl. No. 08/912,185 dated Mar. 31, 2000, 6 pp.

Office Action for U.S. Appl. No. 08/912,185 mailed Sep. 28, 1999, 4 pp.

Notice of Allowability for U.S. Appl. No. 09/627,192, 2 pp.

Office Action for U.S. Appl. No. 10/162,823 mailed Feb. 19, 2003, 4 pp.

Notice of Allowability for U.S. Appl. No. 10/162,823 mailed Dec. 13, 2003, 1 pg.

Office Action for U.S. Appl. No. 10/843,198 mailed Sep. 2, 2009, 7 pp.

Office Action for U.S. Appl. No. 10/843,198 mailed Oct. 1, 2008, 7 pp.

Office Action for U.S. Appl. No. 10/843,198 mailed Aug. 3, 2007, 10 pp.

Office Action for U.S. Appl. No. 10/843,198 mailed Mar. 22, 2007, 10 pp.

Office Action for U.S. Appl. No. 11/424,402 mailed Nov. 25, 2008, 10 pp.

Office Action for U.S. Appl. No. 11/424,402 mailed May 14, 2008, 7 pp.

Office Action for U.S. Appl. No. 11/424,402 mailed Aug. 14, 2007, 5 pp.

Office Action for U.S. Appl. No. 11/424,402 mailed Dec. 10, 2009, 10 pp.

Notice of Allowance for U.S. Appl. No. 11/424,418, mailed Jan. 14, 2010, 4 pp.

Notice of Allowance for U.S. Appl. No. 11/424,418 mailed Jan. 14, 2010, 4 pp.

Notice of Allowance for U.S. Appl. No. 11/424,418 mailed Aug. 7, 2009, 6 pp.

Office Action for U.S. Appl. No. 11/424,418 mailed Aug. 27, 2008, 6 pp.

Office Action for U.S. Appl. No. 11/424,418 mailed Dec. 12, 2007, 10 pp.

Office Action for U.S. Appl. No. 11/424,418 mailed Mar. 21, 2007, 5 pp.

http: www.valottery.com /pick 3 /past years.asp? drawyear = 1996, 3 pp.

http: www. valottery .com /pick 3 / how to play. asp, 17 pp.

Notice of Allowance for U.S. Appl. No. 11/424,402 mailed Jun. 1, 2010, 6 pp.

Office Action for U.S. Appl. No. 10/843,198 mailed Apr. 23, 2010, 8 pp.

* cited by examiner

500

| | TICKET NUMBER 525 | GAME TYPE 530 | NUMBERS SELECTED 535 | PURCHASE DATE 540 | DRAWING DATE 545 | MERCHANT ID# 550 |
|---|---|---|---|---|---|---|
| 505 | 45677 | PICK 6 | 1,4,10,19,31,42 | 6/21/97 | 6/23/97 | 42 |
| 510 | 45679 | PICK 6 | 2,5,11,20,32,43 | 6/21/97 | 6/23/97 | 42 |
| 515 | 45680 | PICK 6 | 3,6,12,21,33,40 | 6/21/97 | 6/23/97 | 43 |
| 520 | 45682 | PICK 6 | 4,7,13,22,34,39 | 6/21/97 | 6/23/97 | 43 |

FIG. 5

600

| TICKET NUMBER 625 | GAME TYPE 630 | NUMBERS SELECTED 635 | PURCHASE DATE 640 | MERCHANT ID# 645 | ACTIVATION CONDITIONS 650 | STATUS 655 |
|---|---|---|---|---|---|---|
| 45678 | PICK 6 | 5,7,20,23,31,36 | 6/21/97 | 42 | JACKPOT OVER $20m | INACTIVE |
| 45681 | PICK 6 | 9,13,22,29,32,38 | 6/21/97 | 43 | DRAWING DATE =6/30/97 | INACTIVE |
| 45683 | PICK 6 | 13,16,19,20,28,30 | 6/21/97 | 43 | JACKPOT OVER $5m | ACTIVE |

605 610 615

FIG. 6

700

| | TICKET NUMBER 725 | GAME TYPE 730 | DRAWING DATE 735 | PRIZE 740 |
|---|---|---|---|---|
| 705 | 34567 | PICK 6 | 6/19/97 | $3,000,000.00 |
| 710 | 38679 | PICK 6 | 6/19/97 | $1,000,000.00 |
| 715 | 45683 | PICK 6 | 6/23/97 | $2.00 |

FIG. 7

PRODUCTS AND PROCESSES FOR APPLYING CONDITIONS TO A LOTTERY ENTRY

The present application is a continuation of U.S. patent application Ser. No. 10/843,198, entitled "PRODUCTS AND PROCESSES FOR APPLYING CONDITIONS TO A LOTTERY ENTRY" filed May 11, 2004;

which is a continuation-in-part of U.S. patent application Ser. No. 10/162,823 entitled "CONDITIONAL LOTTERY SYSTEM" filed Oct. 25, 2001, and issued May 11, 2004 as U.S. Pat. No. 6,733,387; which is a continuation of U.S. patent application Ser. No. 09/627,192 entitled "CONDITIONAL LOTTERY SYSTEM" filed Jul. 27, 2000, and issued Dec. 4, 2001 as U.S. Pat. No. 6,325,716; which is a continuation of U.S. patent application Ser. No. 08/912,185 entitled "CONDITIONAL LOTTERY SYSTEM" filed Aug. 15, 1997, and issued Nov. 14, 2000 as U.S. Pat. No. 6,146,272.

Each of the above-referenced applications is incorporated by reference herein in its entirety.

This application is also related to U.S. application Ser. No. 11/424,402 filed Jun. 15, 2006 and U.S. patent application Ser. No. 11/424,418 filed Jun. 15, 2006.

BACKGROUND

The present invention relates generally to lottery transactions.

As is well known, a lottery is a game in which players receive a chance to win a (typically large) prize, such as money or products in exchange for purchasing entries to the lottery. A lottery ticket typically embodies such an entry.

One lottery game, known as "lotto", typically requires the player to choose six numbers between one and forty-two. The selected group of numbers are then compared to the winning lottery numbers, which have been randomly selected from the larger pool of numbers, between one and forty-two, at some specified time and date after purchase of the lotto ticket. To win a prize, the player-selected lotto ticket numbers must match all or some of the winning lottery numbers.

Typically, a lottery system utilizes a central lottery computer to communicate with remote lottery terminals. A player typically selects numbers on a lottery "sense mark slip", and the lottery terminal operator inserts the sense mark slip into a reader at the lottery terminal, which optically reads the sense mark slip using a known mark sensing process. Alternatively, some lottery systems offer automatic lottery number generation features, commonly referred to as "quick-pick" systems, which randomly select lottery numbers on behalf of the player. The lottery terminal then communicates the player's selected numbers to the central lottery computer for validation and storage. After the lottery numbers have been stored, the lottery terminal, under the direction of the central lottery computer, prints and issues the official lottery ticket.

Lotto drawings are typically conducted on a periodic basis, with many state lotteries conducting lotto drawings twice per week. Players may purchase lotto tickets at a lottery terminal, or via a subscription that automatically enters a player in the lottery game for a predefined number of weeks, often at a discounted price.

If the jackpot prize is not awarded for a particular lotto drawing, the jackpot prize value typically rolls over to increase the jackpot for the subsequent drawing. Thus, jackpots increase from week to week when there is no winner. The amount of the jackpot prize is typically determined based on a sales trend from the prior year.

A drawback of existing lottery systems is the need for some players (e.g., who do not or cannot purchase a subscription) to wait in line in order to purchase a ticket. The typical wait time increases as the potential value of the lottery drawing increases, and as the end of the drawing approaches. Consequently, potential players may be discouraged from participating. Many other features of conventional lottery systems discourage broader participation by players.

BRIEF DESCRIPTION OF THE DRAWINGS

FIG. 5 illustrates a sample table from the ticket database of FIG. 4;

FIG. 6 illustrates a sample table from the conditional ticket database of FIG. 4;

FIG. 7 illustrates a sample table from the winning ticket database of FIG. 4;

DETAILED DESCRIPTION

Figure 1:
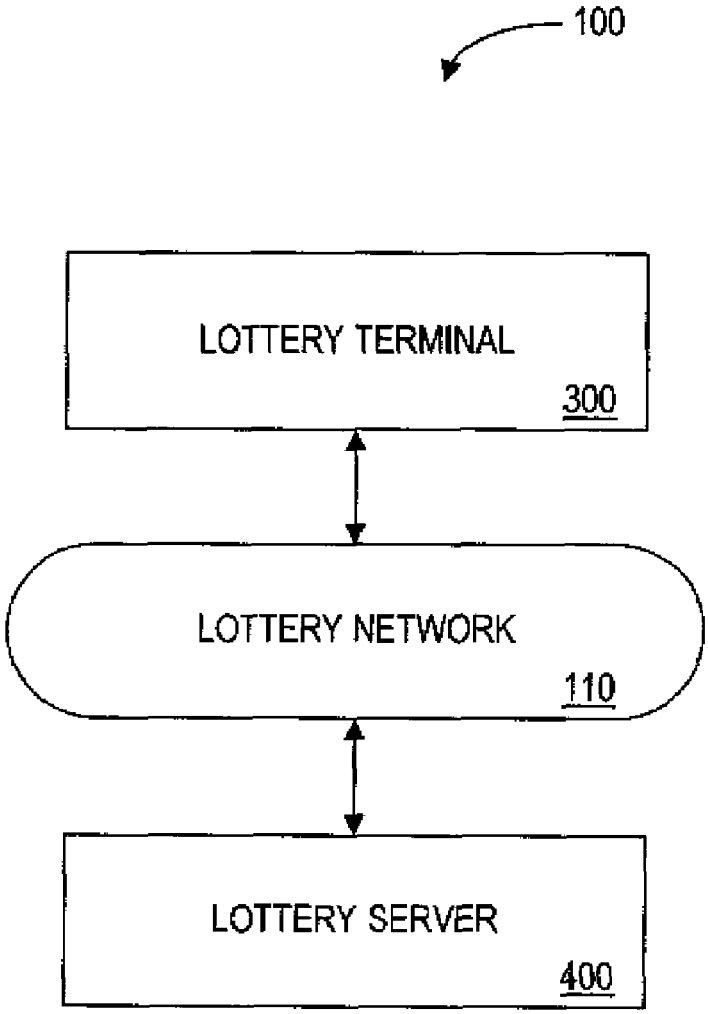
FIG. 1 is a schematic block diagram illustrating a conditional lottery system in accordance with one embodiment of the present invention.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment", "embodiment", "embodiments", "the embodiment", "the embodiments", "one or more embodiments", "some embodiments", and "one embodiment" mean "one or more (but not all) embodiments of the present invention(s)" unless expressly specified otherwise.

The terms "including", "comprising" and variations thereof mean "including but not limited to", unless expressly specified otherwise.

The enumerated listing of items does not imply that any or all of the items are mutually exclusive, unless expressly specified otherwise.

The terms "a", "an" and "the" mean "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

It will be readily apparent that the various methods and algorithms described herein may be implemented by, e.g., appropriately programmed general purpose computers and computing devices. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing instructions which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying a sequences of instructions to a processor.

The present inventors have recognized that allowing lottery entries to be conditioned can significantly increase their desirability. Consequently, sales of such entries can be significant. One example condition is a desired minimum jackpot amount in order to enter an entry in the drawing.

In some embodiments, a lottery ticket becomes "active" when the condition is satisfied (and equivalently, the ticket is not active when the condition is not satisfied). A ticket which is initially inactive may be activated upon a certain condition. A ticket which is initially active may be deactivated upon a certain condition. When a ticket is activated/deactivated, it may remain activated/deactivated only as long as the condition which prompts the activating/deactivating so applies. Alternatively, when a ticket is activated/deactivated, it may remain activated/deactivated irrespective of changes in the condition which prompts the activating/deactivating.

The present inventors have also recognized that since some people only desire to purchase lottery tickets under certain conditions (e.g., large jackpot), allowing such conditions to be imposed on entries is advantageous. Satisfaction of such conditions may be known ahead of time (e.g., every first of the month) or may be unknown ahead of time (e.g., every time it snows more than one inch).

According to one embodiment, a conditional lottery ticket system processes conditional lottery ticket transactions, including the acceptance and validation of play entries. The conditional lottery ticket system preferably includes a central lottery server and one or more remote lottery terminals. The conditional lottery ticket system permits a player to purchase conditional lottery tickets that are not activated (i.e. that are deactivated) unless one or more player-defined conditions are satisfied.

The conditions (which may be defined by the player) may include, for example, a minimum lottery jackpot, a particular future date of activation, or a particular external event, such as when the moon on the drawing date will be a full moon. The player may be permitted to play a conditional lottery ticket at no additional charge over the normal cost of a conventional lottery ticket, as an incentive for increased play, or upon payment of an additional fee, as a premium charged to the player for the convenience offered by the conditional lottery ticket.

In one embodiment, the conditional lottery ticket system permits a player to purchase conditional lottery tickets (i) individually, whereby the player's lottery ticket is activated the next time the player-specified activation conditions are satisfied; (ii) on a subscription basis for a predefined fee, whereby the player's lottery ticket is automatically activated a predefined number of times when the player-specified activation conditions are satisfied; and/or (iii) on a perpetual subscription basis, whereby the player's lottery ticket is automatically activated each time the player-specified activation conditions are satisfied until the subscription is cancelled.

In one embodiment, the conditional lottery ticket system permits the player to specify the numbers to be played for each game, as well as any activation conditions. In one embodiment, a player utilizes a sense mark strip or another suitable computer-readable material, to indicate the numbers to be played and any activation conditions. Alternatively, the conditional lottery ticket system may incorporate a "quick-pick" lottery number generation feature, which randomly selects lottery numbers on behalf of the player, either at the time of sale or at the time the ticket is activated.

The lottery terminal reads the sense mark slip and the player's selected numbers and any specified activation conditions are then communicated to the central lottery server for validation and storage. After the selected lottery numbers and any activation conditions have been stored, the lottery terminal, under the direction of the central lottery server, preferably prints and issues the official lottery ticket, indicating the lottery numbers to be played, as well as any specified activation conditions. The conditional lottery ticket system preferably evaluates the pending conditional lottery tickets to determine if the player-defined activation conditions of any conditional lottery tickets are satisfied on a periodic basis, or at some predefined time period before each lottery drawing.

Another aspect of the invention allows a player to specify one or more side bets, for example, on the number of jackpot winners, or on particular characteristics of the jackpot winners, such as the sex, county, or age of the jackpot winner, preferably for an additional amount over the normal cost of a lottery ticket. Prizes for the side bet can be separately awarded or awarded as a multiplier of conventional lottery jackpot awards.

FIG. 1 shows a conditional lottery ticket system 100 for processing conditional lottery ticket transactions, including the acceptance and validation of play entries, for example, in a state lottery. The conditional lottery ticket system 100 includes a lottery network 110 for transferring information between a central lottery server 400, discussed below in conjunction with FIG. 4, and one or more remote lottery terminals, such as an illustrative lottery terminal 300, discussed below in conjunction with FIG. 3.

In one embodiment, the conditional lottery ticket system 100 permits a player to purchase conditional lottery tickets that are not activated until one or more conditions (for activation or deactivation) are satisfied. Such conditions may be defined by a player, selected by a player and/or imposed on a player. The player may be allowed to specify one or more player-defined conditions (a) at no additional charge over the normal cost of a conventional lottery ticket, as an incentive for increased play, or (b) upon payment of an additional fee, as a premium charged to the player for the convenience offered by the conditional lottery ticket.

A wide variety of conditions are embraced by the present invention. Many conditions are explicitly recited in the present disclosure, and many more will be apparent to those of ordinary skill in the art based on the present disclosure.

For example, in one embodiment, a condition may specify that a lottery ticket should be active when the lottery jackpot exceeds a predefined threshold. For example, the condition may specify that a particular lottery ticket should remain active and should not be deactivated until the lottery jackpot is below the predefined threshold.

In one embodiment, a condition may specify that a lottery ticket should be active when there is no prior winner of the lottery during a predetermined number of previous drawings (e.g., no winner for the last five drawings).

In one embodiment, a condition may specify that a lottery ticket should be active when there is no prior winner of the lottery during a predetermined period of time (e.g., no winner for the last two weeks).

In one embodiment, a condition may specify that a lottery ticket should be active on a particular date or dates (e.g., every drawing in September, on the player's birthday, on even numbered days), or upon the occurrence of some external event, such as when the drawing date will fall on a "Friday the thirteenth."

In one embodiment, a condition may specify that a lottery ticket should be active when at least a predetermined number of tickets have been sold for the drawing.

In one embodiment, a condition may specify that a lottery ticket should be active when a previous winning lottery ticket was purchased at a certain location (e.g., in my town, in my state, at a particular chain of stores).

In one embodiment, a condition may specify that a lottery ticket should be active when a number or numbers on the lottery ticket has been included in a winning lottery entry during a predetermined time period (e.g., at least two of my numbers were on a winning entry in the last twelve months). Similarly, a condition may specify that a lottery ticket should be active when no number on the lottery ticket has been included in a winning lottery entry during a predetermined time period (e.g., none of my numbers were on a winning entry in the last twelve months).

In one embodiment, a condition may specify that a lottery ticket should be active when a particular sports event occurs (e.g., a certain team has won/lost a game this week, a certain player has hit a home run this week, a certain team pitches a shutout).

In one embodiment, a condition may specify that a lottery ticket should be active when a financial event occurs (e.g., a certain company's stock price increases, a certain company's stock price increases more than 10%, the DOW JONES industrial average surpasses 14,000).

In one embodiment, a condition may specify that a lottery ticket should be active when no other lottery ticket includes all the same numbers as the lottery ticket for the next drawing (e.g., when a jackpot would not have to be shared with another player).

In one embodiment, a condition may specify that a lottery ticket should be active when the player who owns the lottery ticket has won a predetermined amount of money on the previous drawing (e.g., won between $10 and $100, won less than $50, won more than $300).

In one embodiment, a condition may specify that a lottery ticket should be active when the purchaser of the ticket has also purchased at least a predetermined number of other tickets, or other items. In such an embodiment, the lottery terminal dispensing tickets could monitor the number of tickets sold in a particular transaction, and apply the activation to a conditional lottery ticket purchased concurrently with a predetermined number of other lottery tickets. Additionally or alternatively, the lottery terminal may receive an identifier that identifies a particular player, thereby allowing lottery ticket sales to be associated with the player. In such an embodiment, the player's ticket purchases may be recorded and tracked even if the purchases occur at different times and/or different locations. Various means for carrying an identifier, including cards with bar codes or magnetic stripes, are known, and such means can be used to provide a player identifier to the lottery terminal. Upon receipt of such an identifier, the identifier can be used to reference a database of players and their associated purchases.

More than one condition may be combined to form a composite condition. In one embodiment, conditions may be joined by Boolean operators such as AND, OR and NOT to form a composite condition. For example, a composite condition may be ((condition 1) OR (condition 2)) AND NOT (condition 3).

A conditional lottery ticket may include more than one associated condition, such that each associated condition corresponds to a particular number of entries (e.g., ticket records created in the active ticket database 500). Such a plurality of associated conditions may be used to purchase different number of entries upon satisfaction of different conditions. For example, a conditional lottery ticket may specify that upon satisfaction of a first condition (the jackpot amount is greater than $25,000,000 but less than $50,000,000) two entries are to be created, and upon satisfaction of a second condition (the jackpot amount is at least $50,000,000) five entries are to be created.

A condition may be subsequently overridden. For example, the player may decide that, regardless of a condition applicable to the ticket, a ticket should be activated or deactivated.

According to a further feature of the invention, the conditional lottery ticket system 100 can permit a player to purchase conditional lottery tickets (i) individually, whereby the player's lottery ticket is activated when the associated condition(s) are satisfied; (ii) on a subscription basis for a predefined fee, whereby the player's lottery ticket is automatically activated up to a predefined number of times when the player-specified activation conditions are satisfied; or (iii) on a perpetual subscription basis, whereby the player's lottery ticket is automatically activated each time the player-specified activation conditions are satisfied until the subscription is cancelled (e.g., inability to charge a specified credit card account or debit card account).

The conditional lottery ticket system 100 may optionally include a mechanism for automatically notifying subscription players of various events, such as a prize won with the ticket, the expiration of a lottery ticket, the activation/deactivation of a ticket, changes in one or more conditions. Such a notification system may transmit messages via a number of ways, such as email, instant message, telephone (e.g., using an automated messaging system), and postal mail. Similarly, such events may be made available in a known manner to a player via a Web site (typically when a player so requests such information by referencing the appropriate web page).

Players may register their preferred means of notification, preferred notification events, and address for notification in a number of known manners (e.g., by registering via a web browser).

The lottery terminal 300 and the central lottery server 400, discussed further below in conjunction with FIGS. 3 and 4, respectively, may comprise conventional hardware and software, as modified herein to carry out the functions and operations described below. The lottery terminal 300 and the central lottery server 400 transmit digitally encoded data and other information between one another over the lottery network 110. The lottery network 110 preferably comprises cable or wireless links on which electronic signals can propagate, and may be embodied, for example, as (i) a dedicated wide area network (WAN), (ii) a telephone network, including the combination of local and long distance wire or wireless facilities and switches known as the public switched telephone network ("PSTN"), or (iii) the Internet. The data and other information transmitted by the lottery terminal 300 to the central lottery server 400 for validation and storage may represent a player's name or identification number, numbers to be played, and any activation conditions. Likewise, the data and other information transmitted by the central lottery server 400 to the lottery terminal 300 may represent play results and an acknowledgement or validation of play information for printing of an official lottery ticket by the lottery terminal 300.

Figure 2A:
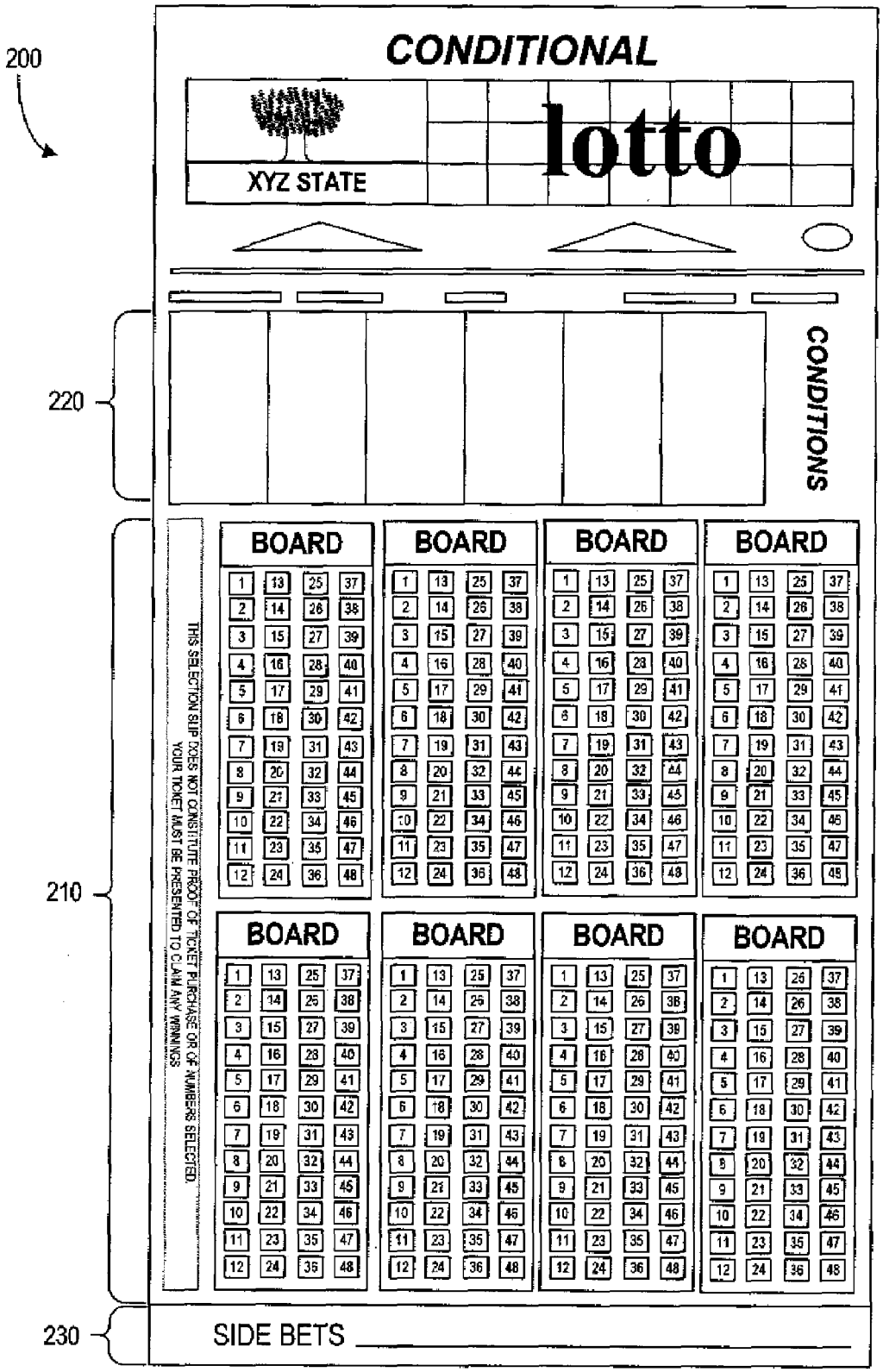
FIG. 2A is an example of an illustrative sense mark slip in accordance with an embodiment of the present invention.

According to a feature of the present invention, the conditional lottery ticket system 100 permits the player to specify the numbers to be played for each game, as well as any activation conditions. In one embodiment, shown in FIG. 2*a*, a player utilizes a sense mark strip 200 or another suitable computer-readable material, to indicate (i) the numbers to be played in a number selection region 210 and (ii) any activation conditions in a condition specification region 220. Alternatively, the conditional lottery ticket system 100 may incorporate an automatic lottery number generation feature, commonly referred to as a "quick-pick" system, which randomly selects lottery numbers on behalf of the player. The "quick-pick" numbers may be generated by the conditional lottery ticket system 100 at the time of sale or at the time the ticket is activated. In such a "quick-pick" embodiment, the activation conditions can nonetheless be specified by the player orally to the operator of the lottery terminal 300 or using a modified sense mark strip 200 or another suitable computer-readable medium.

In an alternate or supplemental embodiment, a player can specify one or more side bets in a region 230 of the sense mark strip 200. Thus, according to a further feature of the invention, the conditional lottery ticket system 100 permits a player to place additional bets, for example, on the number of jackpot winners, or on particular characteristics of the jackpot winners, such as the sex, county, or age of the jackpot winner, preferably for an additional amount over the normal cost of a lottery ticket. Prizes for the side bet can be separately awarded or awarded as a multiplier of conventional lottery jackpot awards, as would be apparent to a person of ordinary skill in the art.

Figure 2B:
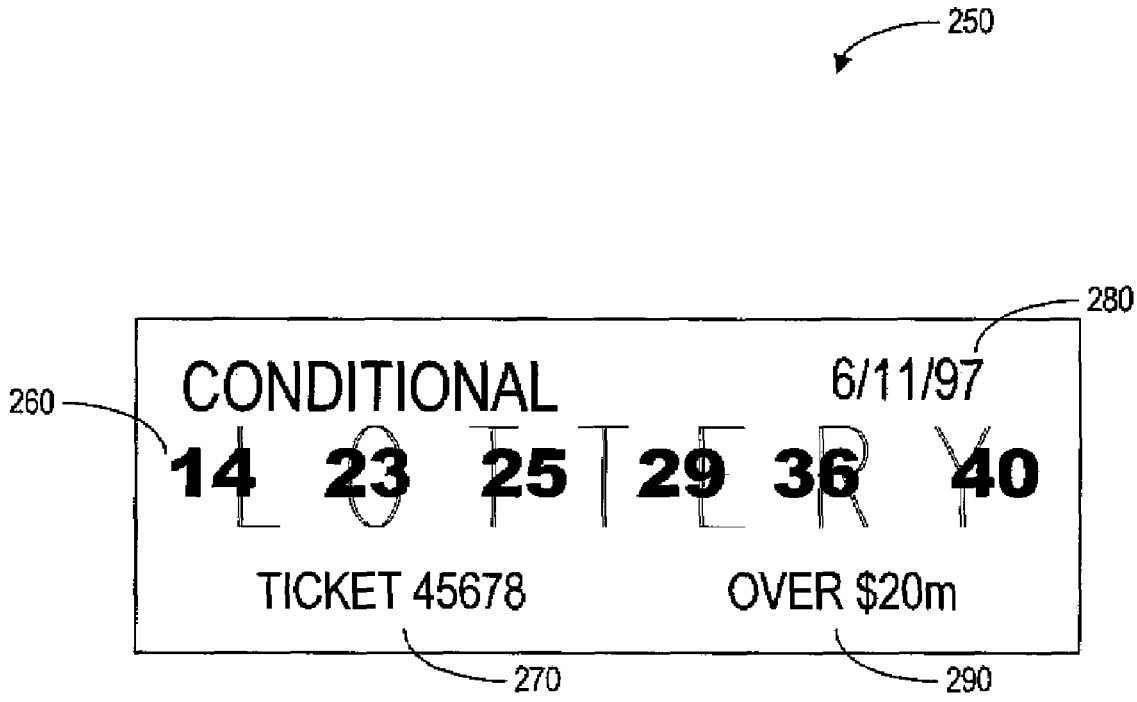
FIG. 2B is an example of an illustrative lottery ticket in accordance with an embodiment of the present invention.

Once the central lottery server 400 has validated and stored the player's numbers and any activation conditions, in a manner discussed further below, the lottery terminal 300 preferably issues a lottery ticket 250, shown in FIG. 2B, to the player indicating the lottery numbers to be played in a field 260, as well as a ticket identification number 270, the date of issuance 280 and any specified activation conditions 290.

Figure 3:
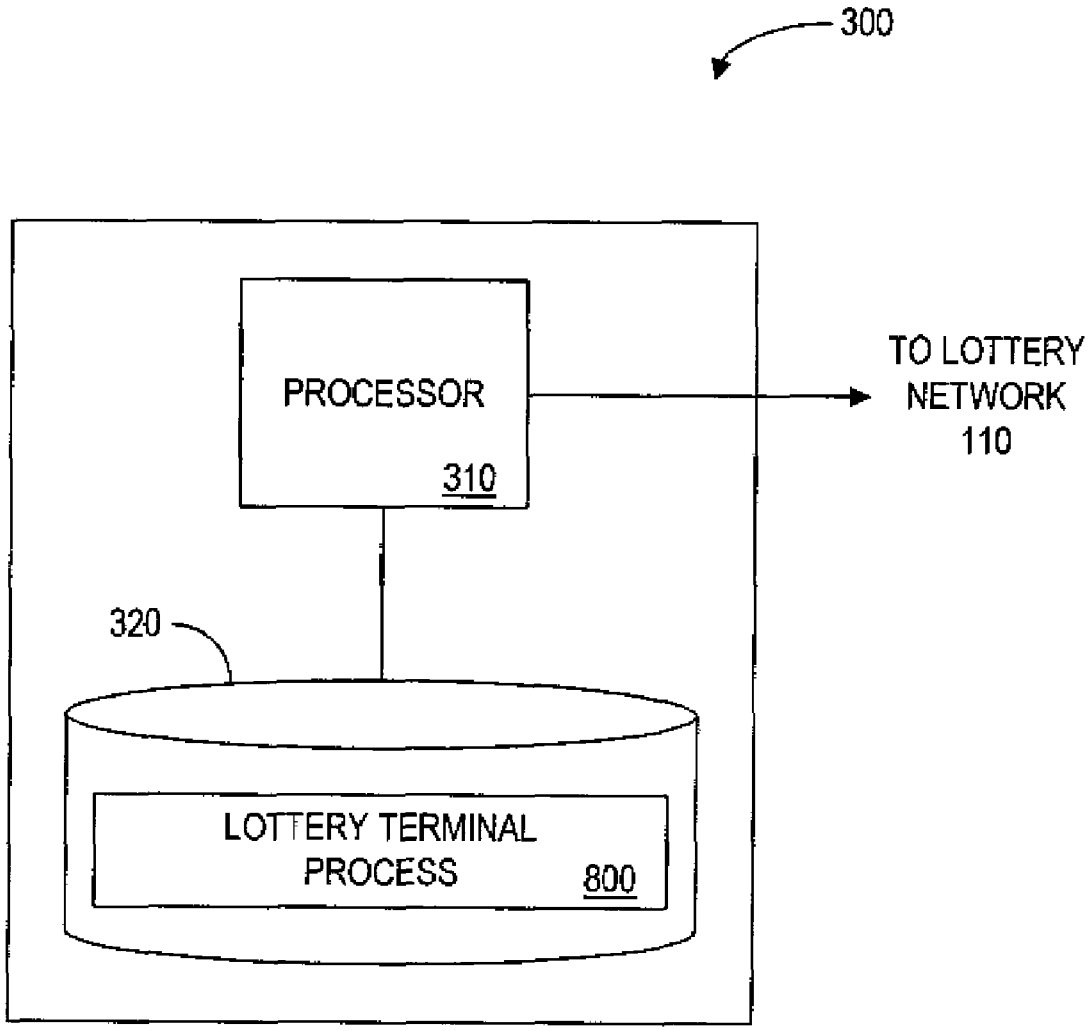
FIG. 3 is a schematic block diagram of an exemplary lottery terminal of FIG. 1.

FIG. 3 is a block diagram showing the architecture of an illustrative lottery terminal 300. The lottery terminal 300 may be embodied, for example, as a conventional dedicated lottery terminal, as modified herein to execute the functions and operations of the present invention. Alternatively, the lottery terminal 300 may be embodied as a point-of-sale terminal that generates sales receipts containing both merchandise sales information and conditional lottery ticket information, as disclosed in U.S. Pat. No. 6,267,670, issued Jul. 31, 2001 and incorporated by reference herein.

The lottery terminal 300 preferably includes a processor 310 and related memory, such as a data storage device 320. The processor 310 may be embodied as a single processor, or a number of processors operating in parallel. The data storage device 320 and/or a read only memory (ROM) are operable to store one or more instructions, which the processor 310 is operable to retrieve, interpret and execute. The processor 310 preferably includes a control unit, an arithmetic logic unit (ALU), and a local memory storage device, such as, for example, an instruction cache or a plurality of registers, in a known manner. The control unit is operable to retrieve instructions from the data storage device 320 or ROM. The ALU is operable to perform a plurality of operations needed to carry out instructions. The local memory storage device is operable to provide high-speed storage used for storing temporary results and control information.

As discussed further below in conjunction with FIG. 8, the data storage device 320 preferably includes a lottery terminal process 800. Generally, the lottery terminal process 800 receives play information from a player, for example, by reading a sense mark strip 200, and communicates with the central lottery server 400 via the lottery network 110 to validate and store the play information and thereafter issue a lottery ticket 250 to the player.

Figure 4:
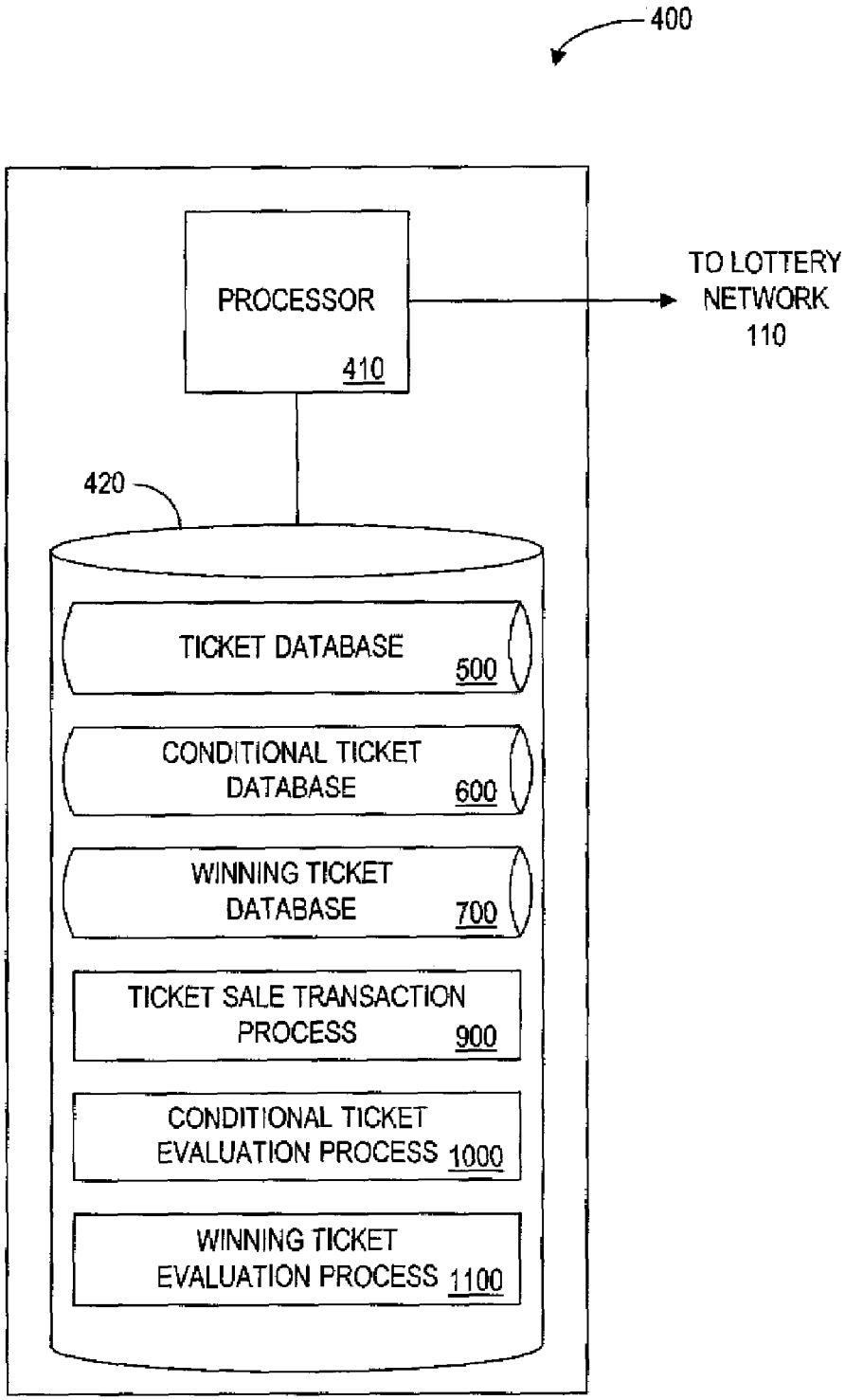
FIG. 4 is a schematic block diagram of an exemplary lottery server of FIG. 1.

FIG. 4 is a block diagram showing the architecture of an illustrative central lottery server 400. The central lottery server 400 may be embodied, for example, as an RS 6000 server, manufactured by IBM Corp., as modified herein to execute the functions and operations of the present invention. The central lottery server 400 preferably includes a processor 410 and related memory, such as a data storage device 420, which operate in a similar manner to the hardware described above in conjunction with FIG. 3.

The processor 410 may incorporate a random number generation function and a cryptographic processing function. The random number generation function may be utilized to generate random "quick-pick" lottery numbers, in the manner described above. The cryptographic processing function may be utilized to encrypt an authentication code that may be associated with a particular lottery transaction.

As discussed further below in conjunction with FIGS. 5 through 7, respectively, the data storage device 420 preferably includes a ticket database 500, a conditional ticket database 600 and a winning ticket database 700. The ticket database 500 preferably stores information on each ticket that is currently active in the conditional lottery ticket system 100. The conditional ticket database 600 preferably stores information on each conditional lottery ticket which is pending in the conditional lottery ticket system 100, including an indication of associated activation conditions. The winning ticket database 700 preferably stores information on each ticket which has won a prize from the conditional lottery ticket system 100, including an indication of the prize amount.

In addition, as discussed further below in conjunction with FIGS. 9 through 11, the data storage device 420 preferably also includes a ticket sale transaction process 900, a conditional ticket evaluation process 1000 and a winning ticket evaluation process 1100. Generally, the ticket sale transaction process 900, shown in FIGS. 9A and 9B, coordinates lottery ticket transactions, such as the acceptance, validation and storage of play entries, including the player's numbers and any activation conditions. The conditional ticket evaluation process 1000, shown in FIG. 10, preferably periodically evaluates pending conditional lottery tickets to determine if the associated player-specified activation conditions are satisfied and thereby activate the conditional ticket. The winning ticket evaluation process 1100, shown in FIG. 11, preferably compares the numbers associated with each activated lottery ticket for a given drawing with winning number combinations to identify winning tickets and associated prize amounts.

FIG. 5 illustrates an exemplary ticket database 500 that preferably stores information on each ticket which is currently active in the conditional lottery ticket system 100. The ticket database 500 maintains a plurality of records, such as records 505-520, each associated with a different active ticket. For each active ticket identified by ticket number in field 525, the ticket database 500 includes an indication of the game type and numbers selected in fields 530 and 535. In addition, the ticket database 500 preferably records the ticket purchase date, drawing date and merchant identifier in fields 540 through 550, respectively.

FIG. 6 illustrates an exemplary conditional ticket database 600 that preferably stores information on each conditional lottery ticket which is pending in the conditional lottery ticket system 100, including an indication of associated activation conditions. The conditional ticket database 600 maintains a plurality of records, such as records 605-615, each associated with a different conditional lottery ticket. For each conditional lottery ticket identified by ticket number in field 625, the conditional ticket database 600 includes an indication of the game type and numbers selected in fields 630 and 635. In addition, the conditional ticket database 600 preferably records the ticket purchase date and merchant identifier in fields 640 and 645, respectively. Finally, the conditional ticket database 600 records the associated activation conditions and current status in fields 650 and 655, respectively.

FIG. 7 illustrates an exemplary winning ticket database 700 that preferably stores information on each ticket that has won a prize from the conditional lottery ticket system 100, including an indication of the prize amount. The winning ticket database 700 maintains a plurality of records, such as records 705-715, each associated with a different winning ticket. For each winning ticket identified by ticket number in field 725, the winning ticket database 700 includes an indication of the game type, drawing date and corresponding prize amount in fields 730 through 740, respectively.

Figure 8:
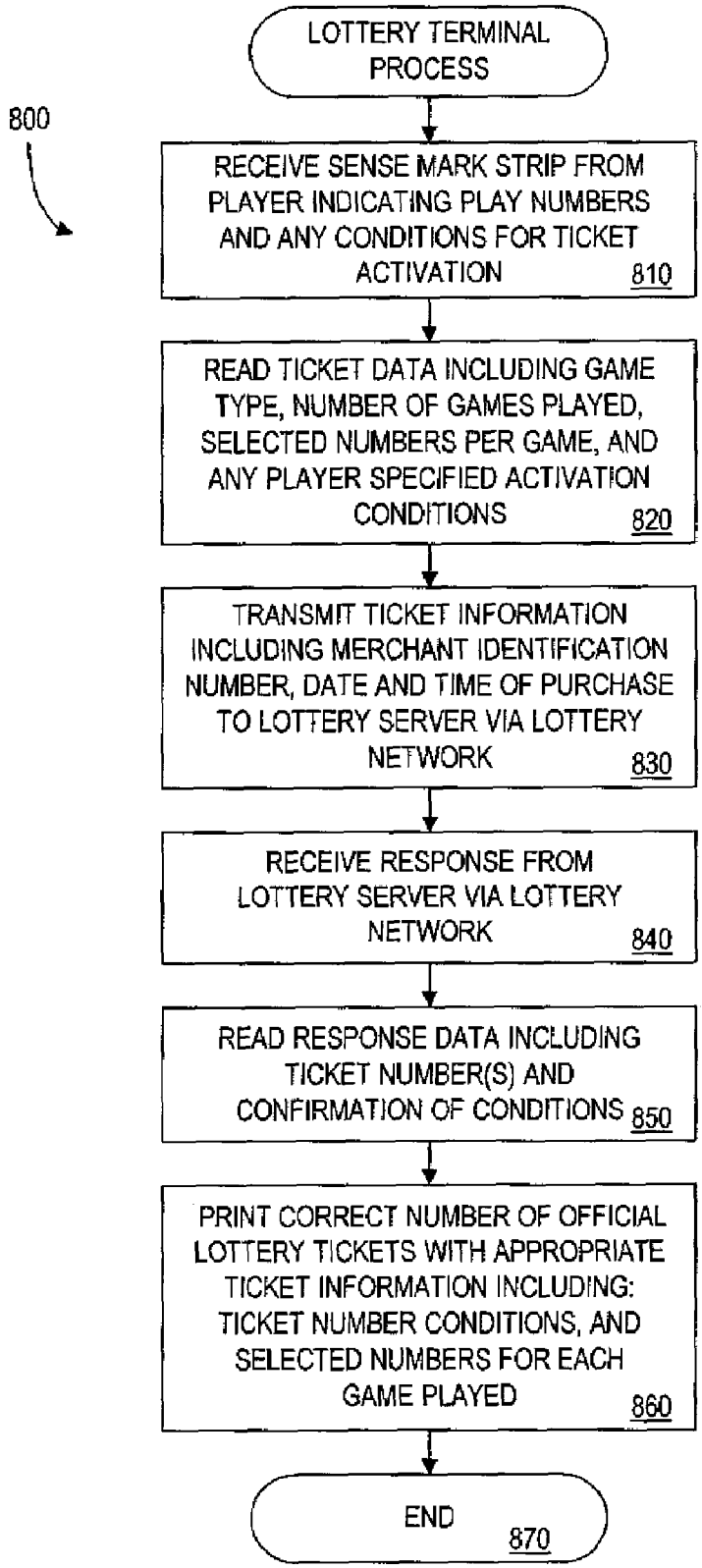
FIG. 8 is a flow chart describing an exemplary lottery terminal process as implemented by the lottery terminal of FIG. 3.

As discussed above, the lottery terminal 300 preferably executes a lottery terminal process 800, shown in FIG. 8, to receive play information from a player, for example, by reading a sense mark strip 200, and to communicate with the central lottery server 400 via the lottery network 110 to validate and store the play information and thereafter issue a lottery ticket 250 to the player. As illustrated in FIG. 8, the lottery terminal process 800 begins during step 810, upon receipt of a sense mark strip 200 from a player indicating play number or any conditions for ticket activation. It is noted that in a "quick-pick" implementation, the play numbers will preferably be randomly generated by the processor 410 of the central lottery server 400.

The lottery terminal 300 will then read the ticket data from the sense mark strip 200, during step 820, including the game type, number of games played, selected numbers per game, and any player-specified activation conditions. Thereafter, the ticket information obtained in the previous step is preferably transmitted to the central lottery server 400 during step 830, together with a merchant identifier, and time and date of purchase.

The lottery terminal 300 will wait for a response from the central lottery server 400 during step 840 and thereafter read the received response during step 850, including the ticket number which has been assigned by the central lottery server 400 and a confirmation of the activation conditions.

Finally, the lottery terminal 300 will print the correct number of official lottery tickets during step 860 with the appropriate ticket information, preferably including the assigned ticket number, activation conditions and selected numbers for each game played, before program control terminates during step 870.

Figure 9A:
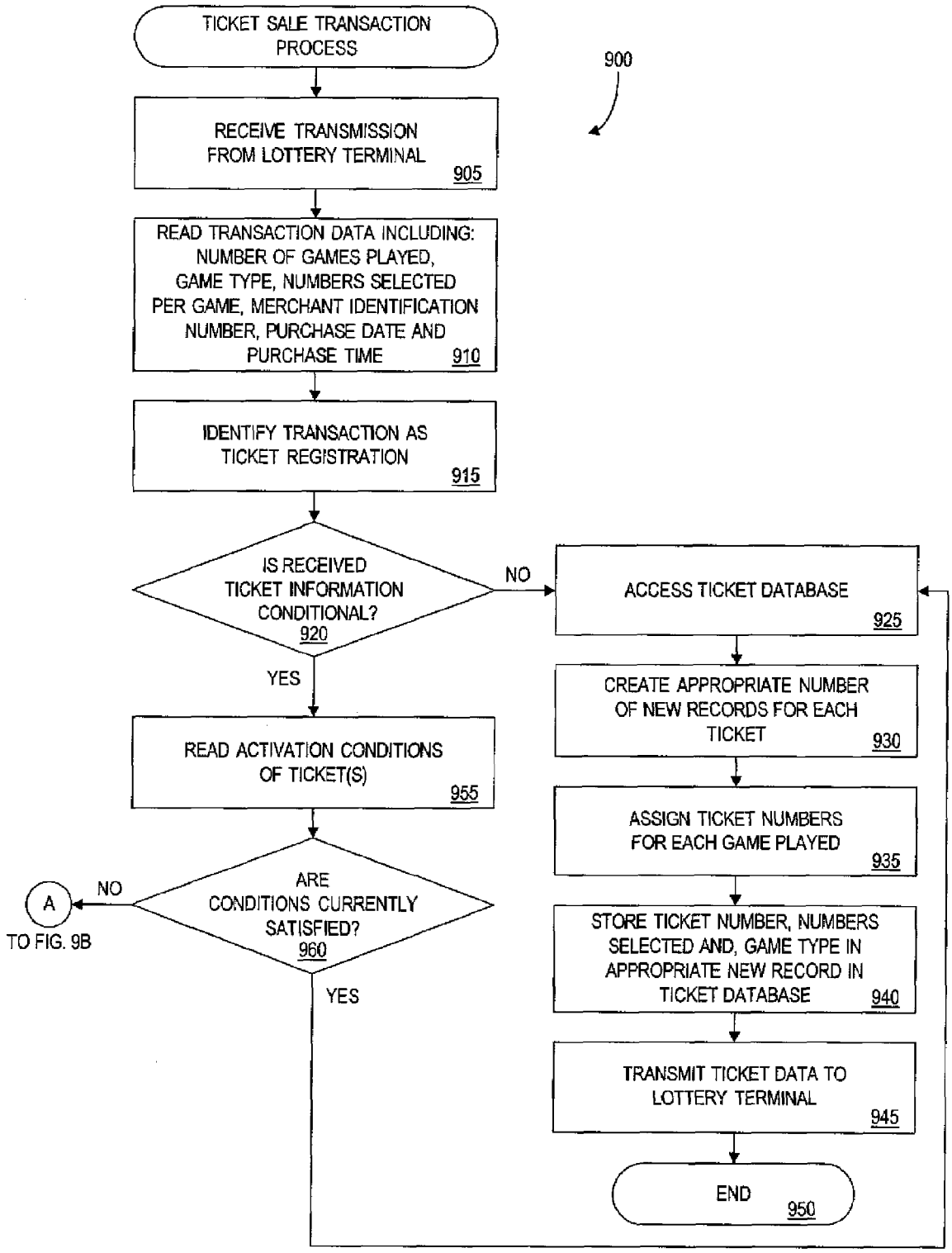
FIGS. 9A and 9B, collectively, are a flow chart describing an exemplary ticket sale transaction process as implemented by the lottery server of FIG. 4.
Figure 9B:
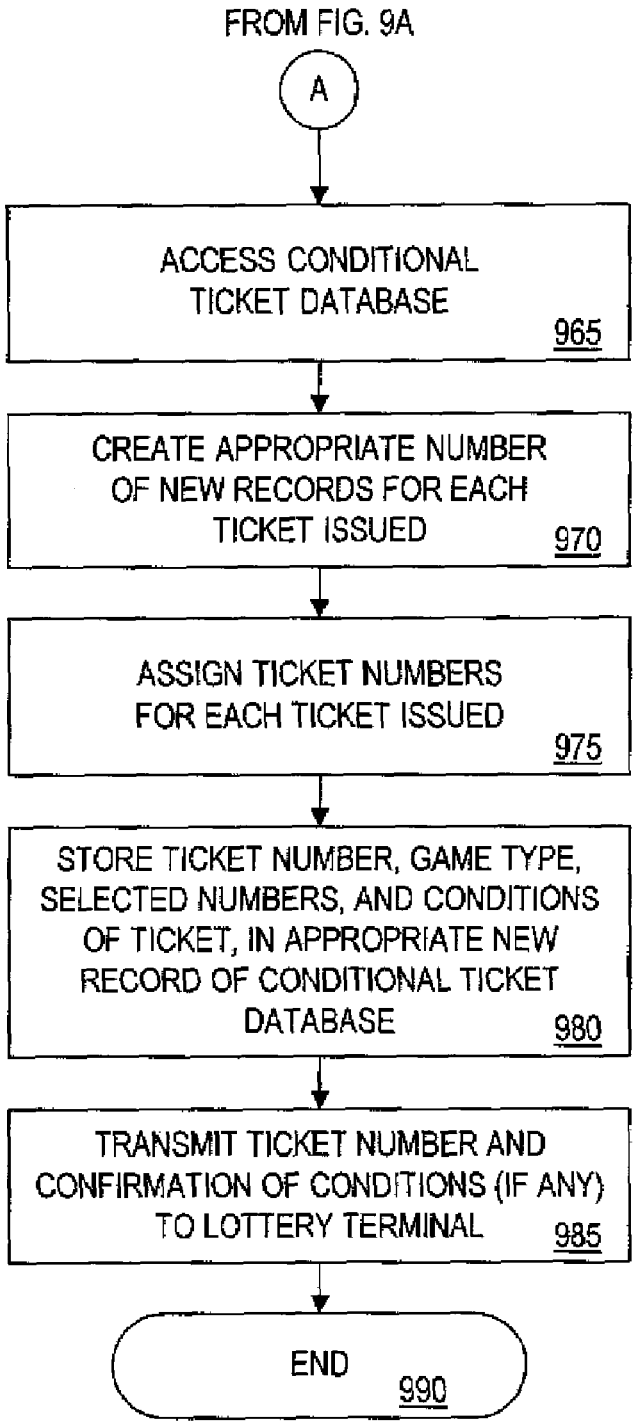

As discussed above, the central lottery server 400 preferably executes a ticket sale transaction process 900, shown in FIGS. 9A and 9B, to coordinate lottery ticket transactions, such as the acceptance, validation and storage of play entries, including the player's numbers and any activation conditions. As illustrated in FIG. 9A, the ticket sale transaction process 900 begins during step 905, upon receipt of a transmission from a lottery terminal 300. Thereafter, the central lottery server 400 will read the transaction data during step 910, including the number of games played, game type, numbers selected per game played, merchant identifier, and purchase time and date.

The ticket sale transaction process 900 will then identify the transaction as a ticket registration during step 915. A test is then performed during step 920 to determine if the received ticket information is conditional. If it is determined during step 920 that the received ticket information is not conditional, then the ticket sale transaction process 900 will access the ticket database 500 during step 925 and then create an appropriate number of new records in the ticket database 500 for each active ticket during step 930. Thereafter, ticket numbers are assigned during step 935 for each game played, before the ticket number, numbers selected and game type are stored in the appropriate new record in the ticket database 500 during step 940. The ticket data is then transmitted to the lottery terminal 300 during step 945 before program control ends during step 950.

If, however, it is determined during step 920 that the received ticket information is conditional, then the activation conditions of the tickets are read during step 955 and a test is then performed during step 960 to determine if the conditions are currently satisfied. If it is determined during step 960 that the conditions are currently satisfied, then program control proceeds to step 925 to activate the tickets and create ticket records in the ticket database 500, in the manner described above. For example, if the amount of the jackpot prize already exceeds five million dollars ($5,000,000) at the time ticket number 45683 (FIG. 6) is sold, then the ticket is automatically activated at the time of the sale, and a ticket record is automatically created in the active ticket database 500.

If, however, it is determined during step 960 that the conditions are not currently satisfied, then program control proceeds to step 965 (FIG. 9*b*) to store the play information in the conditional ticket database 600. Thus, the ticket sale transaction process 900 will access the conditional ticket database 600 during step 965 and then create an appropriate number of new records in the conditional ticket database 600 for each conditional ticket during step 970. Thereafter, ticket numbers are assigned during step 975 for each conditional game played, before the ticket number numbers selected, game type and activation conditions are stored in the appropriate new record in the conditional ticket database 600 during step 980. The ticket data is then transmitted to the lottery terminal 300 during step 985, together with confirmation of any activation conditions, before program control ends during step 990.

Figure 10:
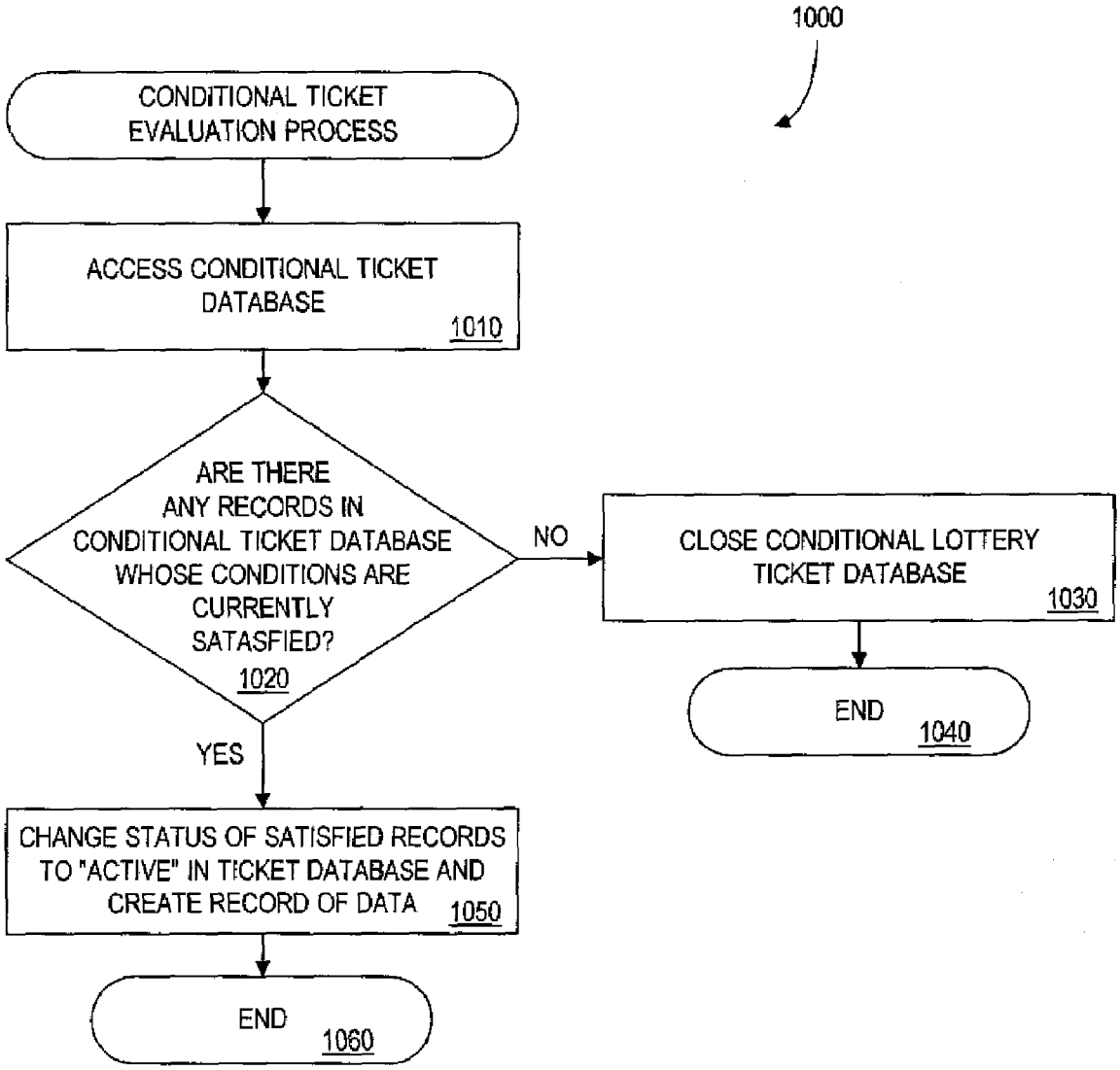
FIG. 10 is a flow chart describing an exemplary conditional ticket evaluation process as implemented by the lottery server of FIG. 4.

As previously indicated, the central lottery server 400 preferably periodically executes the conditional ticket evaluation process 1000, shown in FIG. 10, to evaluate pending conditional lottery tickets to determine if the associated player-specified activation conditions are satisfied and thereby activate the conditional ticket. As illustrated in FIG. 10, the conditional ticket evaluation process 1000 begins during step 1010, by accessing the conditional ticket database 600. A test is then performed during step 1020 to determine if there are any records in the conditional ticket database 600 having activation conditions that are currently satisfied. If it is determined during step 1020 that there are no records in the conditional ticket database 600 having activation conditions which are currently satisfied, then the conditional ticket database 600 is closed during step 1030 before program control terminates during step 1040.

If, however, it is determined during step 1020 that there are records in the conditional ticket database 600 having activation conditions which are currently satisfied, then the ticket is activated during step 1050 by changing the status of the satisfied records in the conditional ticket database 600 to "active" and creating a record of the data in the ticket database 500. For example, if the jackpot prize exceeds five million dollars ($5,000,000) at the time the conditional ticket evaluation process 1000 is executed, then ticket number 45683 (FIG. 6) will be activated, and a ticket record is created in the active ticket database 500. Thereafter, program control terminates during step 1060.

In one embodiment, the player may be required to pay a certain amount for each ticket record created in the active ticket database (for each entry). In one embodiment, the player may be required to pay a certain amount for a conditional lottery ticket, regardless of the number of corresponding entries that are created. In one embodiment, the player may be required to pay a certain amount for a conditional lottery ticket, but is permitted only up to a maximum number of corresponding entries.

In one embodiment, payment is rendered at the time an entry is created (e.g., upon satisfaction of a condition). Preferably, a means for automatically charging the customer is employed, such as a credit card account which may be charged automatically. To identify the credit card account, a credit card number can be provided by a customer, e.g., during a registration process, during acquisition of the conditional lottery ticket at a lottery terminal. Other payment identifiers (e.g., debit card account number, PayPal® identifier) may be specified.

Figure 11:
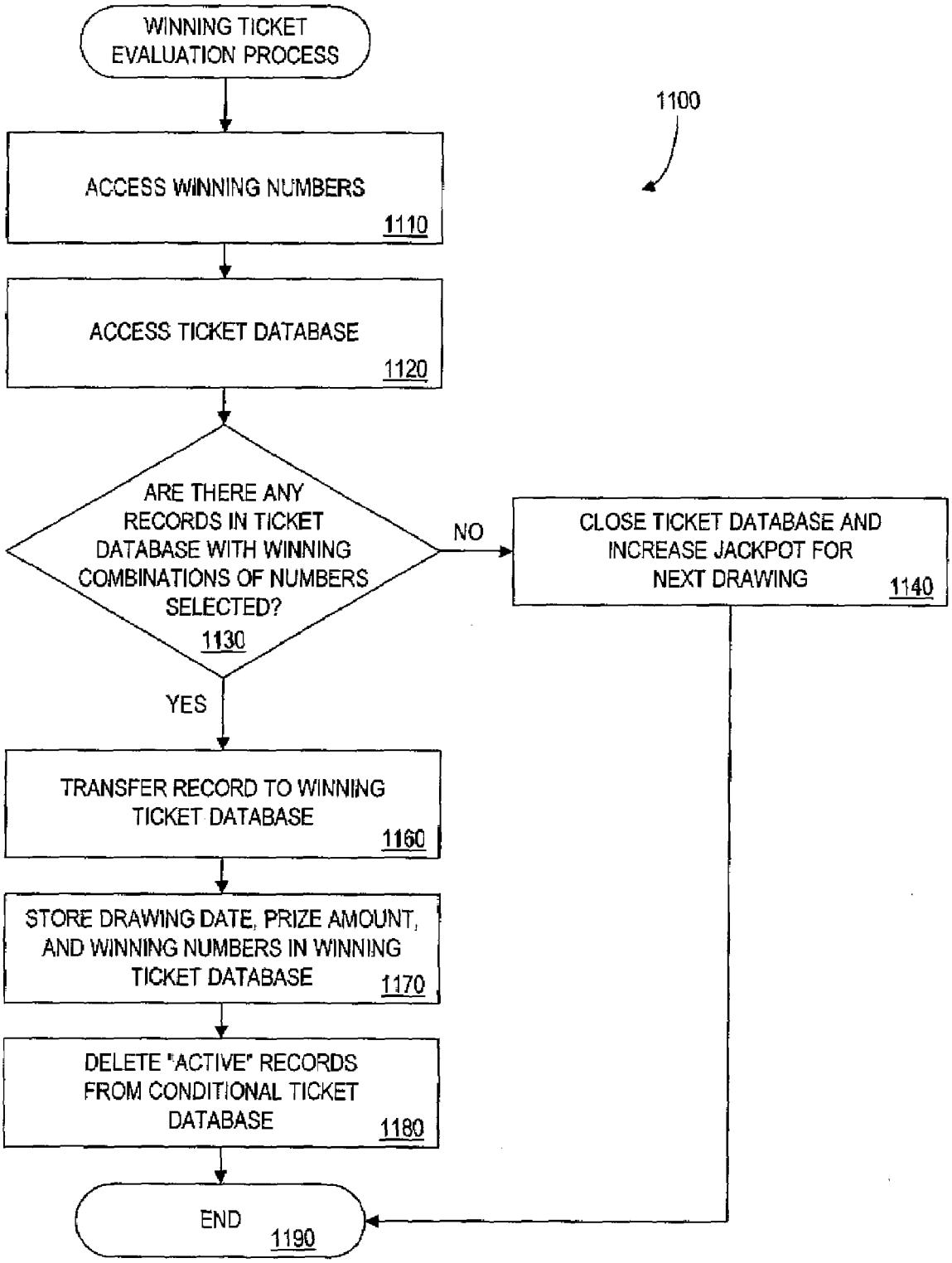
FIG. 11 is a flow chart describing an exemplary winning ticket evaluation process as implemented by the lottery server of FIG. 4.

The central lottery server 400 preferably executes a winning ticket evaluation process 1100, shown in FIG. 11, to identify winning tickets and associated prize amounts. As illustrated in FIG. 11, the winning ticket evaluation process 1100 initially accesses the set of winning numbers during step 1110 and the ticket database 500 during step 1120. A test is then performed during step 1130 to determine if there are any records in the ticket database 500 with winning combinations of numbers selected. If it is determined during step 1130 that there are no records in the ticket database 500 with winning combinations of numbers selected, then the ticket database 500 is closed during step 1140 and the jackpot is preferably increased for the next drawing, before program control terminates during step 1190.

If, however, it is determined during step 1130 that there are records in the ticket database 500 with winning combinations of numbers selected, then records having such winning combinations are preferably transferred to the winning ticket database 700 during step 1160. The drawing date, prize amount and winning numbers are preferably stored in each new record of the winning ticket database 700 during step 1170. Thereafter, the, "active" records from the conditional ticket database 600 are preferably deleted during step 1180 before program control terminates during step 1190.

It is to be understood that the embodiments and variations shown and described herein are merely illustrative of the principles of this invention and that various modifications may be implemented by those skilled in the art without departing from the scope and spirit of the invention.

We claim:

1. A method comprising:

receiving a request of a player to purchase a conditional lottery ticket, the request including an indication of at least one player-specified condition for automatically activating the conditional lottery ticket;

in exchange for payment from the player, issuing an inactive conditional lottery ticket to the player, in which the inactive conditional lottery ticket is not activated at the time of purchase by the player;

storing, in a database, an indication of the at least one player-specified condition and an indication that the inactive conditional lottery ticket issued to the player is inactive, in association with an identifier that identifies the inactive conditional lottery ticket issued to the player;

after purchase of the inactive conditional lottery ticket by the player, determining that the at least one player-specified condition is not satisfied currently; and after determining that the at least one player-specified condition is not satisfied currently, overriding the at least one player-specified condition that is not satisfied currently and activating the inactive conditional lottery ticket regardless of the at least one player-specified condition.

2. The method of claim 1, in which overriding the at least one player-specified condition that is not satisfied currently and activating the inactive conditional lottery ticket comprises:

overriding the at least one player-specified condition that is not satisfied currently and activating the inactive conditional lottery ticket in response to an indication of a decision by the player that the inactive conditional lottery ticket should be activated regardless of the at least one player-specified condition associated with the inactive conditional lottery ticket.

3. A method comprising:

receiving a request of a player to purchase a conditional lottery ticket, the request including an indication of at least one player-specified condition for automatically activating the conditional lottery ticket;

in exchange for payment from the player, issuing an active conditional lottery ticket to the player;

storing, in a database, an indication of the at least one player-specified condition and an indication that the active conditional lottery ticket issued to the player is active, in association with an identifier that identifies the active conditional lottery ticket issued to the player; and deactivating the active conditional lottery ticket regardless of the at least one player-specified condition, in which the deactivated conditional lottery ticket is eligible to be reactivated automatically based on the at least one player-specified condition.

4. The method of claim 3, further comprising:

after purchase of the active conditional lottery ticket by the player, determining that the at least one player-specified condition is satisfied currently; and in which deactivating comprises:

overriding the at least one player-specified condition that is satisfied currently.

5. The method of claim 3, in which deactivating the active conditional lottery ticket comprises:

deactivating the active conditional lottery ticket in response to an indication of a decision by the player that the active conditional lottery ticket should be deactivated regardless of the at least one player-specified condition associated with the active conditional lottery ticket.

6. The method of claim 3, further comprising:

determining that the at least one player-specified condition is satisfied; and in response to determining that the at least one player-specified condition is satisfied, automatically reactivating the deactivated conditional lottery ticket.

7. A computer readable medium storing instructions operable to direct a computing device to perform a method, the method comprising:

receiving a request of a player to purchase a conditional lottery ticket, the request including an indication of at least one player-specified condition for automatically activating the conditional lottery ticket;

in exchange for payment from the player, issuing an inactive conditional lottery ticket to the player, in which the inactive conditional lottery ticket is not activated at the time of purchase by the player;

storing, in a database, an indication of the at least one player-specified condition and an indication that the inactive conditional lottery ticket issued to the player is inactive, in association with an identifier that identifies the inactive conditional lottery ticket issued to the player;

after purchase of the inactive conditional lottery ticket by the player, determining that the at least one player-specified condition is not satisfied currently; and after determining that the at least one player-specified condition is not satisfied currently, overriding the at least one player-specified condition that is not satisfied currently and activating the inactive conditional lottery ticket regardless of the at least one player-specified condition.

8. A computer readable medium storing instructions operable to direct a computing device to perform a method, the method comprising:

receiving a request of a player to purchase a conditional lottery ticket, the request including an indication of at least one player-specified condition for automatically activating the conditional lottery ticket;

in exchange for payment from the player, issuing an active conditional lottery ticket to the player;

storing, in a database, an indication of the at least one player-specified condition and an indication that the active conditional lottery ticket issued to the player is active, in association with an identifier that identifies the active conditional lottery ticket issued to the player; and deactivating the active conditional lottery ticket regardless of the at least one player-specified condition, in which the deactivated conditional lottery ticket is eligible to be reactivated automatically based on the at least one player-specified condition.

* * * * *